US005575234A

United States Patent [19]

Dysarz

[11] Patent Number: 5,575,234

[45] Date of Patent: Nov. 19, 1996

[54] BOAT AND DOCK STANDOFF

[76] Inventor: Edward D. Dysarz, 11423 Triola Ln., Houston, Tex. 77072

[21] Appl. No.: 556,506

[22] Filed: Nov. 13, 1995

[51] Int. Cl.[6] ..... B63B 21/00

[52] U.S. Cl. ..... 114/230; 114/218

[58] Field of Search ..... 114/218, 230, 114/249, 250, 221 R, 219

[56] References Cited

U.S. PATENT DOCUMENTS

| | | | |
|---|---|---|---|
| 3,019,759 | 2/1962 | Woods | 114/230 |
| 3,142,284 | 7/1964 | Kauffman | 114/230 |
| 4,297,963 | 11/1981 | Beacom | 114/230 |
| 4,587,603 | 5/1986 | Hughes | 362/427 |
| 4,977,846 | 12/1990 | Landa et al. | 114/230 |
| 5,120,016 | 6/1992 | Dysarz | 248/539 |

*Primary Examiner*—Edwin L. Swinehart

[57] ABSTRACT

A device to fix a floating boat to a dock or pier that will allow the boat to move up and down freely in the waves and yet prevent the boat from hitting the dock or pier or rub the piles supporting the dock or pier. The device is comprised of two elongated arms that are fixed to a cleat fixture on a boat wherein the elongated arms extend to the dock forming a triangle with a V bar or a T bar, a swivel and a pinion fixed to the dock or pier, thereby allowing the boat to move up and down within limits but not to strike or rub the dock, pier or piles.

16 Claims, 9 Drawing Sheets

BOAT AND DOCK STANDOFF

There are various means of holding a boat to a dock or pier, the most common being rope. A boat is generally tied to a dock or pier with at least two sections of rope, one section of rope is tied off from the bow of the boat to the dock and the other section of rope is tied off from the stern to the dock. This device and method is efficient in that it prevents the boat from drifting away from the dock or pier but does not prevent the boat from being pushed into the dock when a wave strikes the boat, and does not prevent the boat, dock or pier from being damaged in various ways. Often boat bumpers are used between the boat and the dock or pier but the boat will often go over the bumpers or under the bumpers and still damage the boat, dock or pier.

There are also such devices known as mooring whips which are bolted or perminently fixed to the dock and can be used for only one particular boat. There must be two mooring whips used to moor a boat to a dock. One mooring whip extends well over the bow of the boat and the other mooring whip extends over the stern of the boat. Both mooring whips require a series of lines extending from the cleat on the boat to the mooring whip and to the cleat on the dock. The mooring whips cannot be carried in the boat for use on another dock nor can they be used on a boat larger or smaller than the boat they were fastened to the dock or pier to be used for.

The boat and dock standoff of this invention can be carried on any boat and used on any wooden dock that one desires to moor their boat on. The boat and dock standoff does not have to be bolted to the dock or boat and therefor it can easily be removed and easily be reset on another dock.

SUMMARY

The object of the present invention is to make a convenient boat and dock mooring system that will prevent the boat from ramming the dock or rubbing on the dock due to wave action.

It is still another object of the present invention to provide a boat and dock mooring system that can be conviently stored and carried in a small or large boat or ship.

It is yet another object of the present invention to provide a boat and dock mooring system that can be installed in seconds.

It is still yet another object of the present invention to provide a boat or ship mooring system that will fit on any size dock, pier, boat or ship.

The features of the present invention can best be understood together with further objects and advantages by reference to the following descriptions taken in connection with accompanying drawings wherein like numerals indicate like parts.

DETAILED DESCRIPTION OF THE PREFERRED EMBODIMENTS

Figure 1:
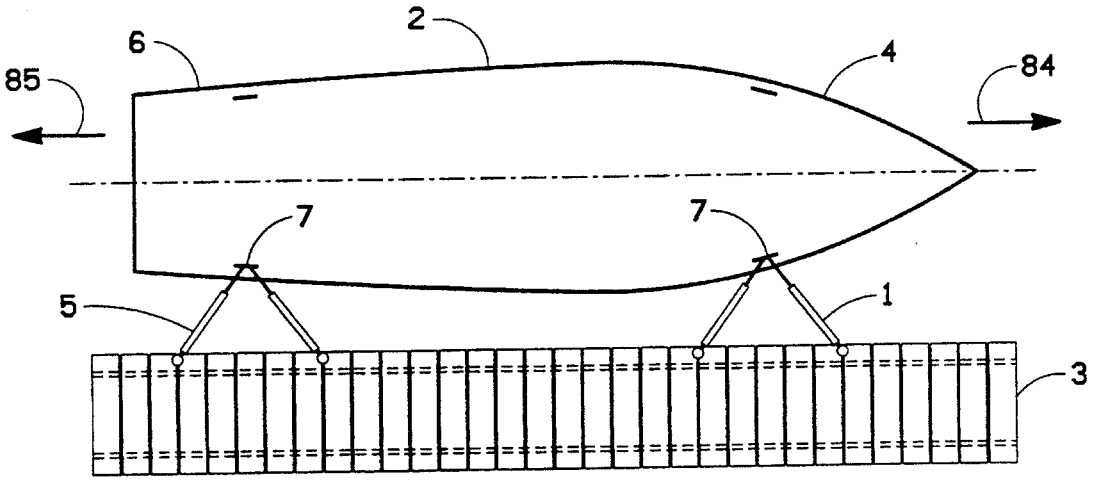
FIG. 1 is a plan view of two of the preferred embodiments mooring a boat to a dock or pier.

Referring to FIG. 1 there is shown a plan view of the first boat and dock standoff 1 of the first preferred embodiment mooring a boat 2 to a dock 3. The first boat and dock standoff 1 is shown near the forward end 4 of the boat 2. A second boat and dock standoff 5 is shown near the aft end 6 of the boat 2. The first boat and dock standoff 1 is shown suitably fixed to a cleat 7 that is suitably fixed to the boat 2. The second boat and dock standoff 5 is also shown suitably fixed to a cleat 7 which is also suitably fixed to the boat 2. The first boat and dock standoff 1 is the same as the second boat and dock standoff 5 and therefore only the first boat and dock standoff 1 will need to be described. The first boat and dock standoff 1 and the second boat and dock standoff 5 each form a triangle to prevent the boat 2 from moving forward 84 or aftward 85 relitive to the dock 3 as well as preventing the boat 2 from drifting away from the dock 3 or striking the dock 3 that could result from wind, waves or tides reacting with the boat 2.

Figure 2:
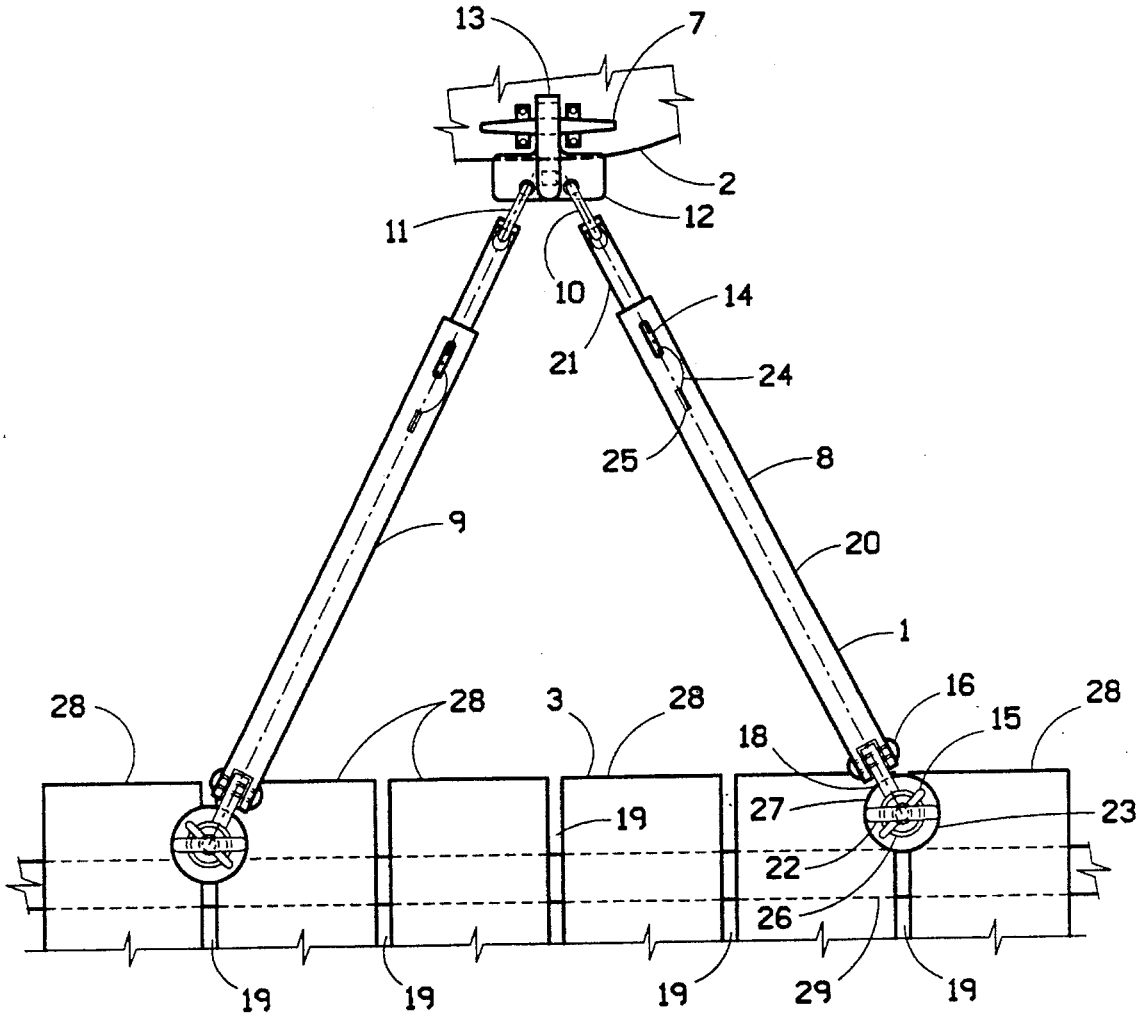
FIG. 2 is an enlarged plan view of the preferred embodiment of FIG. 1.

Referring to FIG. 2 there is shown an enlarged plan view of the first boat and dock standoff 1 mooring a boat 2 to a dock 3. The first boat dock standoff 1 is comprised of a first arm 8 and a second arm 9 that forms an apex with the pivot plate 12 at the first end of the first arm 8 and the first end of the second arm 9. The first arm 8 and the second arm 9 are flexibly fixed to the pivot plate 12 by the first pivot ring 10 and the second pivot ring 11 respectivly. The cleat hook 13 is hooked around the cleat 7 which is fixed to the boat 2; the cleat hook 13 is suitably fixed to or is part of the pivot plate 12. Although the cleat hook is shown, a rope, a snap, or other suitable means could be used to connect the pivot plate 12 to the cleat 7 by design choice.

The first arm 8 and the second arm 9 are both equal and the same and therefore only the first arm 8 will be described.

The first arm 8 is shown formed by an inner bar 21 and an outer bar 20 that essentially form a telescopic arm. The first arm 8 can be lengthened by pulling stop pin 14 out of the inner bar 21 and the outer bar 20 to either lengthen or shorten the first arm 8 as required or desired. When the first arm 8 is of the desired length, the stop pin 14 is reinserted into the holes formed in the inner bar 21 and the outer bar 20.

At the second end of the first arm 8 there is shown a pivot plate 18 that is fixed to the second end of the first arm 8 by a first pivot pin 16. The first pivot pin 16 is sufficiently loose to allow the first arm 8 to rotate about the first pivot pin 16. The first pivot pin 16 extends through a hole formed in the first side and the third side of the outer bar 20 and the first pivot pin 16 also extends through a hole formed in the vertical pivot plate 18.

The vertical pivot plate 18 is shown suitably fixed to the rotational ring 26 that will be shown more clearly in FIGS. 3, 5, 6 and 7 and is part of the dock attachment device 27. The dock attachment device 27 is shown suitably fixed to the dock 3 by a method that will be shown more clearly in other figures. The lower washer 23, the rotation bar 22 and the wing nut 15 are all part of the dock attachment device 27. The dock attachment device 27 will be attached to the dock 3 by placing components into the slot 19 formed between the dock boards 28 that make up the dock 3.

Figures 3, 4:
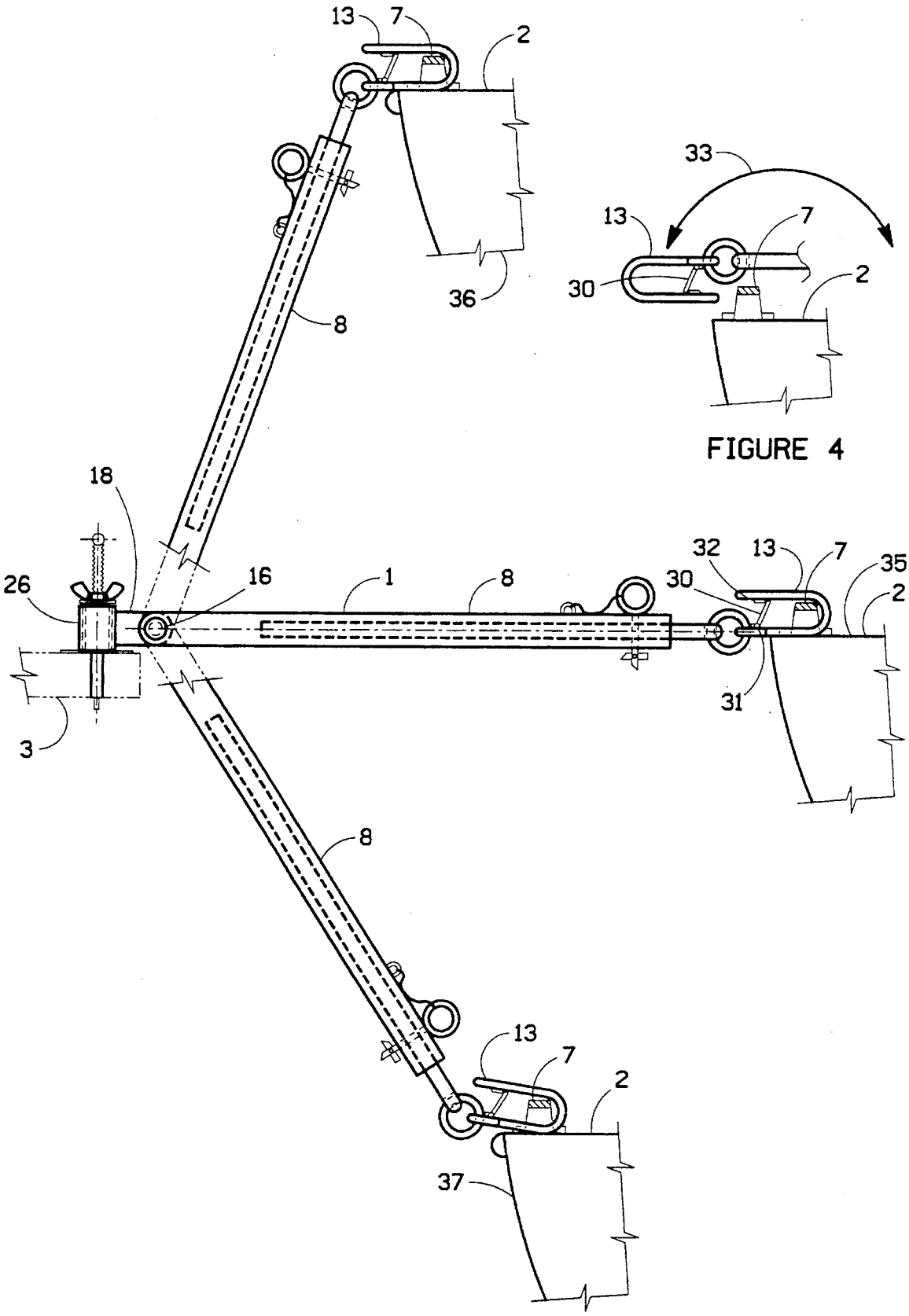
FIG. 3 is an elevation view of the preferred embodiment describing the vertical motion that the device will allow.
FIG. 4 is a section elevation view of the device being attached to a cleat.

Referring to FIG. 3 there is shown an elevation view of the first dock standoff 1 fixed to a dock 3 and a boat 2.

A cleat 7 is shown suitably mounted on the boat 2 and the cleat hook 13 is shown hooked around the cleat 7. The cleat hook 13 shown is by design choice; a rope or any other type of hook snap, tape or hook and loop device could be used to fix the first arm 8 or the second arm to an existing cleat 7 or slot not shown on the boat 2. The cleat hook 13 is shown with a cleat stop 30. The cleat stop 30 has a first end suitably fixed to a cleat stop spring 31 and a second end that is at rest against a stop bar 32. The stop bar 32 prevents the cleat stop 30 from opening and thus prevents the cleat 7 from being released.

To place the cleat 7 into the cleat hook 13 or to remove the cleat from the cleat hook 13, the cleat hook 13 must be rotated, as shown in FIG. 4, the cleat stop 30 must be pushed in and the cleat hook 13 will either be removed from the cleat 7 or placed on the cleat 7.

FIG. 3 shows the boat 2 wherein the boat 2 is level 35 with the dock 3 or the boat 2 is shown above 36 the dock 3 in a wave or high tide and the boat 2 is shown below 37 the dock 3 in a trough of a wave or at low tide. FIG. 3 demonstrates the ability of the boat 2 to be in waves not shown or high and low tides while still being suitably fixed to the dock without bumping or rubbing on the dock 3.

The first arm 8 is shown rotating about the first pivot pin 16 and the vertical pivot plate 18 and the rotational ring 26 without hitting the dock 3 and further allowing the boat 2 to stand off of the dock 3.

Referring to FIG. 4 there is shown the cleat hook 13 rotated 33 about 180° in order to hook the cleat 7 or unhook the cleat 7. When the cleat hook 13 is rotated 33 it is pulled over the cleat 7 wherein the cleat stop 30 is forced open in one direction and captures the cleat 7 in the cleat hook 13. To release the cleat 7 from the cleat hook 13, the cleat stop 30 is pushed in and the cleat is released and thus releasing the boat 2.

Figure 5:
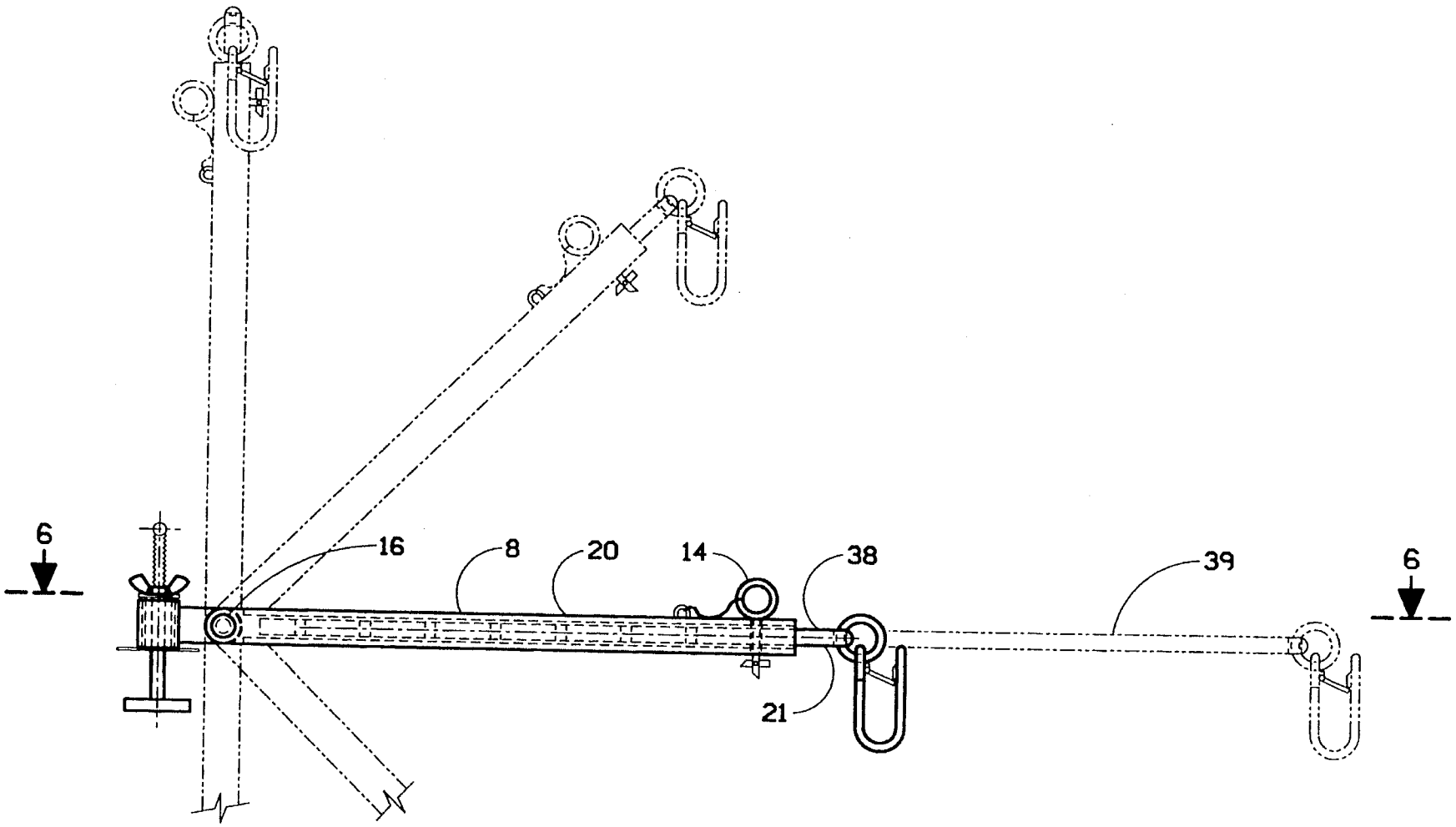
FIG. 5 is a elevation view of the device of the preferred embodiment describing the extension of the device.

Referring to FIG. 5 there is shown an elevation view of the first arm 8 in five different positions as the first arm rotates about the first pivot pin 16.

The first arm 8 is also shown extended from the short position 38 to the elongated position 39. The short position 38 or the elongated position 39 will be determined by the size of the boat, the height of the dock, the tides, how far or close the boat should be from the dock or the possible size of the waves that will strike the boat.

To lengthen or shorten the first arm 8, the stop pin 14 is pulled out of the outer bar 20 and the inner bar 21, the inner bar 21 is pulled out of the hollow outer bar 20 to the desired length and then the stop pin 14 is reinserted into the appropriate holes formed in the hollow outer bar 20 and the inner bar 21 after the holes formed in the hollow outer bar 20 and inner bar 21 are suitably aliened.

Figure 6:
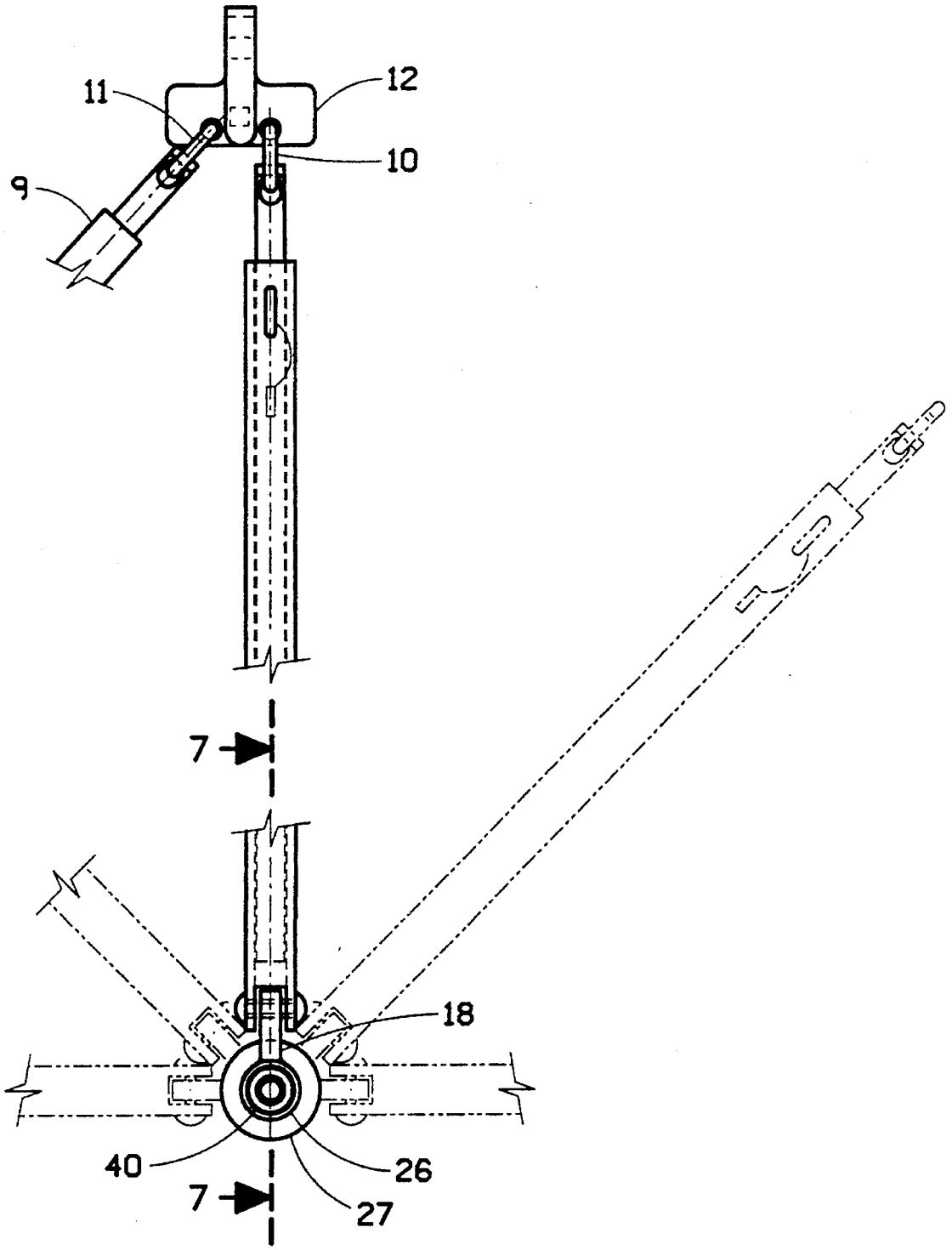
FIG. 6 is a section plan view of the device of the preferred embodiment as taken through FIG. 5.

Referring to FIG. 6 there is shown an enlarged section plan view as taken through FIG. 5 of the first boat and dock standoff 1. The first arm 8 of the first dock standoff 1 is shown in five various positions, however, when the first arm 8 and the second arm 9 are both suitably fixed to the dock, each arm will only be allowed to rotate a few degrees or more because with both the first arm 8 and the second arm 9 suitably fixed to the dock, they form a triangle and only the slight flexibility of the combination of the first pivot ring 10, the second pivot ring 11 and the pivot plate 12 will allow the first arm 8 and the second arm 9 to move laterally some.

Figure 7:
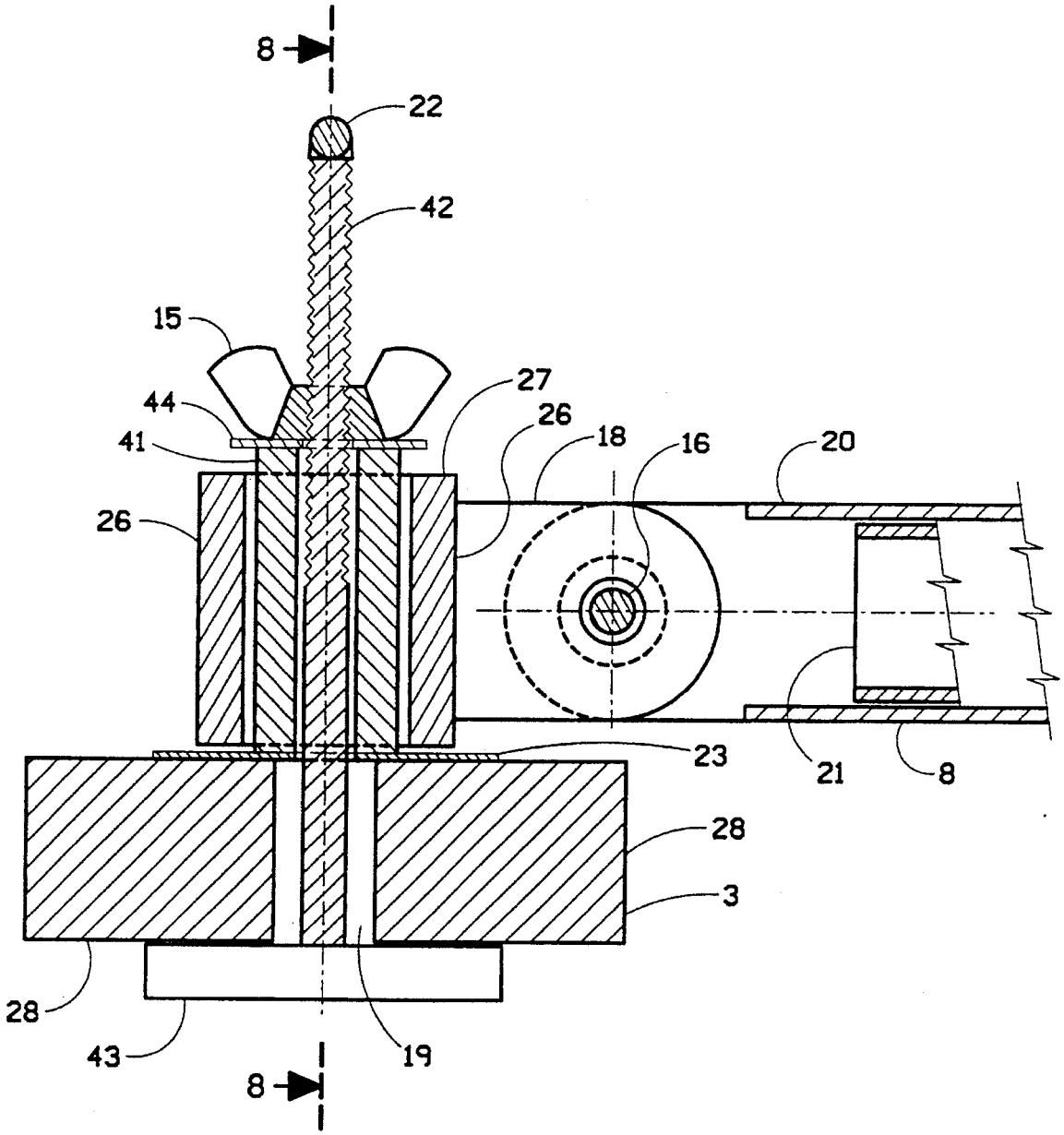
FIG. 7 is an enlarged section elevation of the device of the preferred embodiment as taken through FIG. 6.
Figure 8:
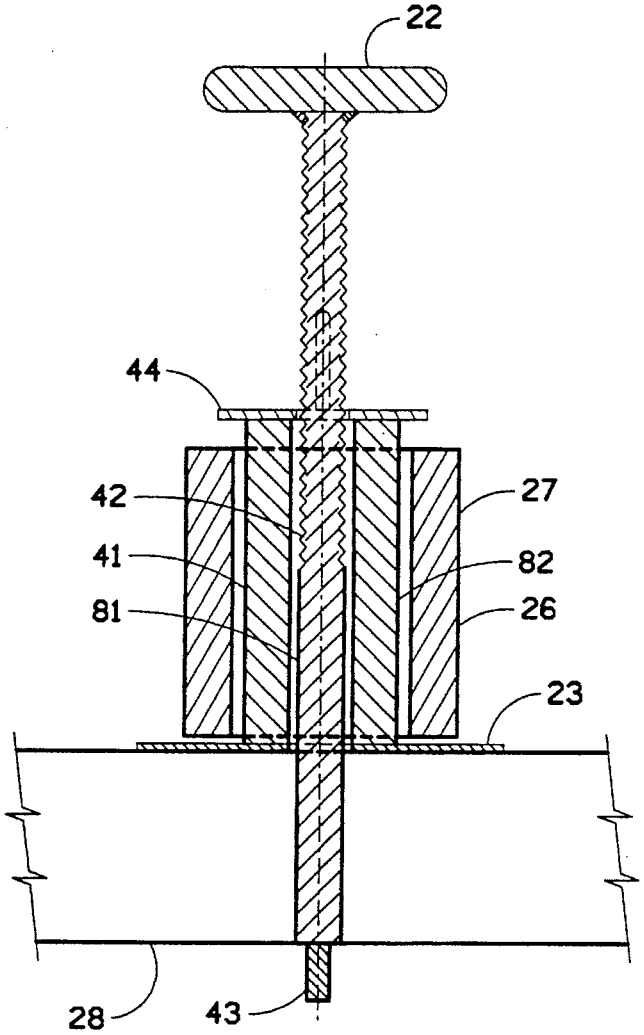
FIG. 8 is an enlarged section elevation of the device of the preferred embodiment as taken through FIG. 7.

The first arm 8 is shown fixed to the vertical pivot plate 18 which is further suitably fixed to the rotation ring 26 which further rotates about the inner pivot ring 40 which is part of the dock attachment device 27 which will be shown more clearly in FIG. 7 and FIG. 8.

Referring to FIG. 7 there is shown an enlarged section elevation of the dock attachment device 27 as taken through FIG. 6.

A section of the hollow outer bar 20 is shown suitably fixed to the vertical pivot plate 18 near the first end of the vertical plate 18 by the first pivot pin 16. The second end of the vertical pivot plate 18 is shown suitably fixed to the outside of the rotation ring 26 by welding or adhesive or some other suitable means. For reference, part of the inner bar 21 is shown held or contained in the hollow outer bar 20.

The rotation ring 26 has a first end, a second end and has a hole formed in the center that extends from the first end to the second end. The rotation ring 26 is allowed to rotate freely about the inner tube 41. The inner tube 41 has a first end and a second end and is longer than the rotation ring 26. The rotation ring 26 has a greater inside diameter than the outside diameter of the inner tube 41, which will allow the rotation ring to rotate about the inner tube 41.

The inner tube 41 has a hole formed in the center that extends from the first end to the second end of the inner tube 41. The hole formed in the inner tube 41 is greater in diameter than the inner rod 42 that is located near the center of the inner tube 41.

The inner rod 42 has a first end and a second end. A rotation bar 22 is shown suitably fixed to the first end of the inner rod 42 by welding or other suitable means. The rotation bar is shown more clearly in FIG. 8. The inner rod 42 has threads formed on the surface from the first end and the threads extend toward the second end of the inner rod 42. A T-bar 43 is suitably fixed to the second end of the inner rod 42 by welding or other suitable means.

The T-bar 43 has a first end and a second end and it is suitably fixed to the inner rod 42 near the center of the T-bar 43. The T-bar 43 is shown spanning the slot 19 formed between the dock boards 28.

The inner tube 41 is shown suitably fixed to the lower washer 23 at the second end of the inner tube 41 and the first side of the lower washer 23 by welding or other suitable means. The second side of the upper washer 44 is shown bearing on the first end of the inner tube. The wing nut 15 is shown bearing on the first side of the upper washer 44.

To install the dock attachment device 27 the wing nut 15 is sufficiently loose on the inner rod 42 allowing the inner rod 42 and the T-bar 43 to be inserted into the slot 19, the T-bar 43 is lowered to where the upper end of the T-bar is below the lower side of the dock boards 28. The T-bar 43 is rotated below the dock boards 28 and the wing nut 15 is turned and tightened pulling up on the inner rod 42 and the T-bar 43 until the upper end of the T-bar 43 is pressed into the lower side of the dock boards 28 wherein the wing nut 15 further thrusts down on the upper washer 44 which further presses or thrusts down on the inner tube 41 which further thrusts down on the lower washer 23 and further thrusts down on the dock boards 28 thus compressing the dock boards 28 between the lower washer 23 and the T-bar 43 thus locking the dock attachment device 27 to the dock 3. While the inner rod 42 is in tension between the T-bar 43 and the wing nut 15, the inner tube 41, the upper washer 44 and the lower washer 23 are in compression, the rotation ring 26 is held to freely rotate about the inner tube 41.

To remove the dock attachment device from the dock boards 28, the wing nut 15 is turned to loosen the wing nut 15 on the inner rod 42 thus loosening the T-bar 43 and the lower washer 23 wherein the T-bar is further rotated to where it is parallel to the dock boards 28 and the T-bar 43 and inner rod 42 are removed from between the dock boards 28.

Referring to FIG. 8 there is shown an enlarged section view of the dock attachment device 27 as taken through FIG. 7.

The rotation bar 22 is shown from the side wherein the rotation bar 22 may be easily grasped with the fingers, hands and thumb.

The T-bar 43 is shown in section crossing a dock board 28. The inner rod 42 is shown inside of the inner tube 41 with space 81 between the outside of the inner rod 42 and the inside of the inner tube 41 wherein the rod may move up and down freely. There is also a gap 82 shown between the inside of the rotation ring 26 and the outside of the inner tube 41 to allow the rotation ring 26 to rotate freely about the inner tube 41 and still be held in place by the lower washer 23 and upper washer 44.

Figure 9:
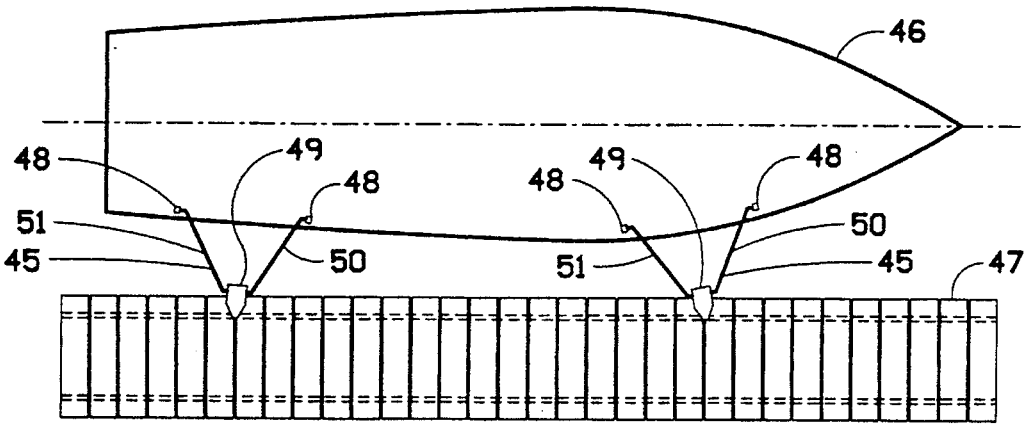
FIG. 9 is a plan view of two of the second preferred embodiments mooring a boat to a dock or pier.

Referring to FIG. 9 there is shown a second preferred embodiment of a boat to dock standoff 45, standing off another boat 46 from another dock 47.

Each boat to dock standoff 45 in FIG. 9 is shown with two standoff fixtures 48 suitably fixed to the boat 46 with bolts, adhesive, welding or other suitable means. The boat to dock standoff 45 has only one dock attachment fixture 49 which forms the apex of a triangle between the first elongated arm 50 and the second elongated arm 51. The attachment fixture 49 is shown locked or fixed to the dock 47.

Figure 10:
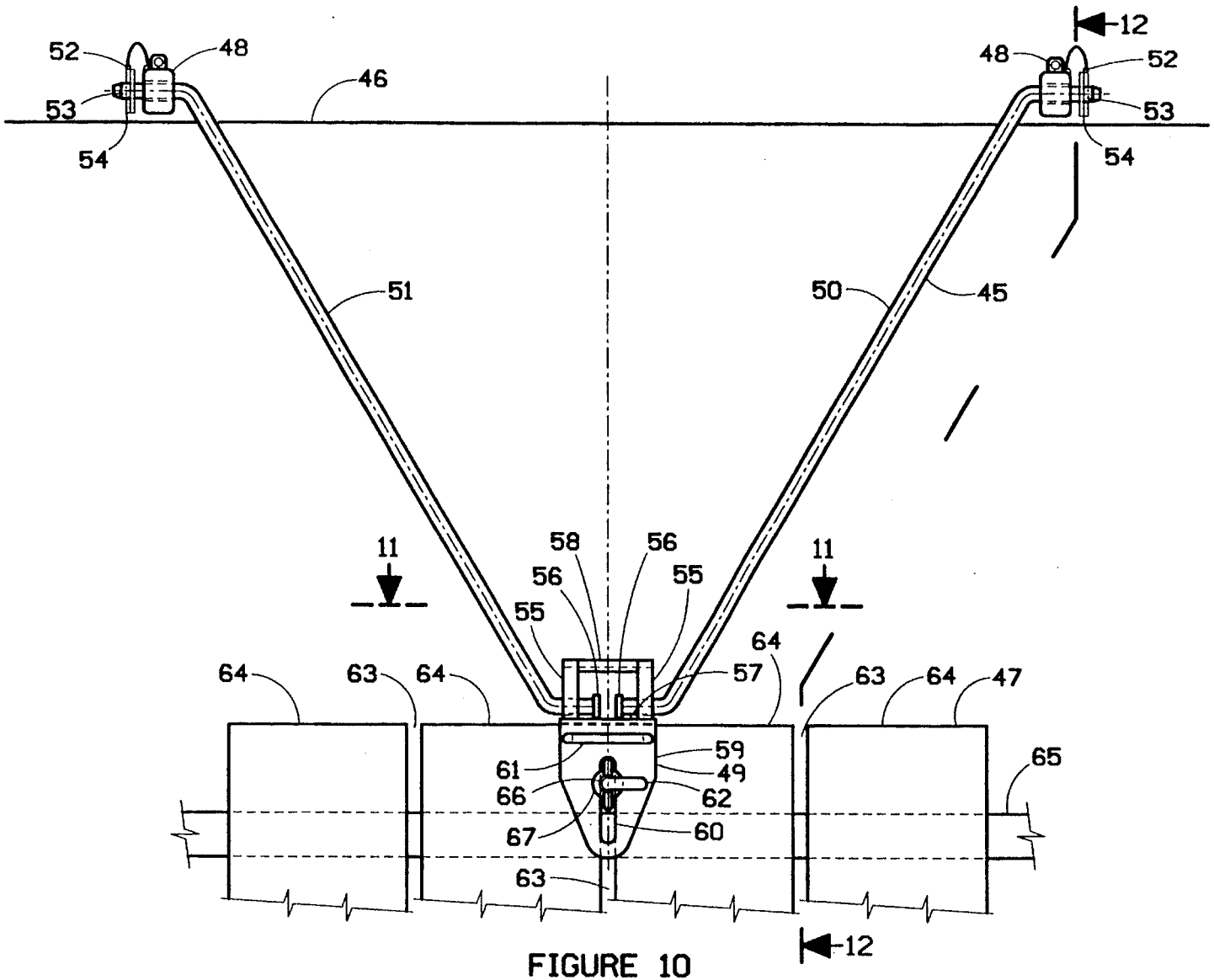
FIG. 10 is an enlarged plan view of the second preferred embodiment.

Referring to FIG. 10 there is shown an enlarged plan view of a boat to dock standoff 45.

The boat to dock standoff 45 is shown with a first elongated arm 50 and a second elongated arm 51. The first end of the first elongated arm 50 and the first end of the second elongated arm 51 are shown bent to allow the elongated arms to be inserted into at least one standoff fixture 48. The standoff fixtures 48 are suitably fixed to the boat 46. The first end of the first elongated arm 50 and the first end of the second elongated arm 51 are shown with a retainer pin 52 inserted into a hole 53 formed in the first end of each elongated arm; the hole 53 extends from one side through the other side of each elongated arm. To withdraw each elongated arm from the standoff fixtures, the retainer pin 52 is removed and the first end of each elongated arm is removed. When the elongated arm is inserted into the standoff fixture 48, the retainer pin 52 is reinserted into the hole 53 and the elongated arm is suitably fixed to the standoff fixture, while being allowed to rotate in the standoff fixture 48.

A washer 54 is also shown between the standoff fixture 48 and the retainer pin 52; when the boat 46 moves up and down in the waves, the first end of the first elongated arm 50 and the first end of the second elongated arm 51 will rotate in the standoff fixture 48 and the washer 54 will prevent or protect the retainer pin 52 from rubbing on the standoff fixture 48.

The second end of the first elongated arm 50 and the second elongated arm 51 are shown bent into the dock attachment fixture 49 wherein the first elongated arm 50 and the second elongated arm 51 are inserted into the elongated slot formed in each extended standoff plate 55. An end cap 56 is shown suitably fixed to the second end of each elongated arm to prevent the elongated arm from being withdrawn or pulled out of the elongated slot formed in the standoff plates.

The second end of the standoff plate 55 is shown suitably fixed to the cap plate 57 by welding or other suitable means by design choice. Near the first end of the extended standoff plate 55 there is shown an end bar 58 to strengthen the extended standoff plates 55. The end bar 58 is suitably conected by welding or other suitable means.

The cap plate 57 is shown suitably fixed to the first end of the dock plate 59 which is shown with a horizontal elongated slot 60. A handle 61 is shown suitably fixed to the dock plate 59 near the first end of the dock plate 59. The rotation bar 62 is near the second end of the dock plate 59. The wing nut 66 and the wing washer 67 is shown above the dock plate 59.

The dock attachment fixture 49 is shown suitably fixed to the dock 47 with the T-bar inserted into a slot 63 formed between the boards 64 that form the dock 47. A dock beam 65 that the boards 64 or planks are fastened to is shown below the boards 64.

Figure 11:
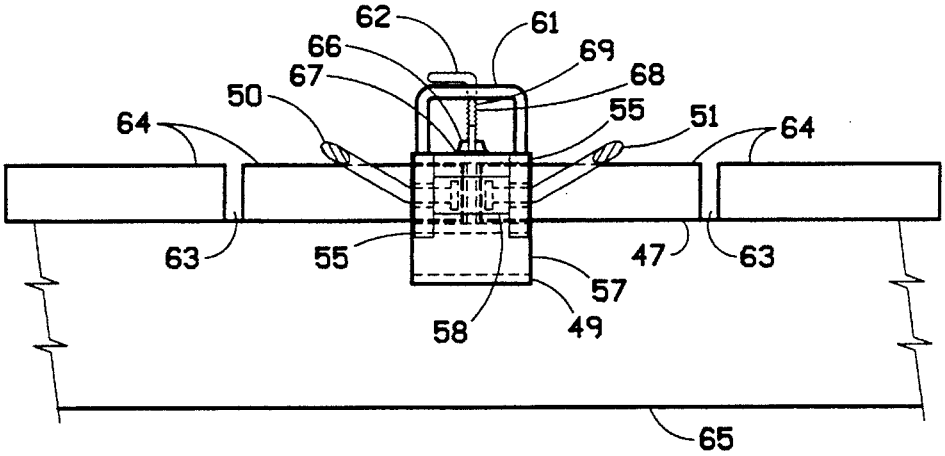
FIG. 11 is a section elevation as taken through FIG. 10.

Referring to FIG. 11 there is shown a section elevation of the dock attachment fixture 49 suitably fixed to the dock 47.

The dock beam 65 is shown below the dock boards 64 or planks. There are two slots 63 shown on each side of the dock attachment fixture 49. The cap plate 57 is shown over or covering the slot that the dock attachment fixture 49 is suitably attached to.

The extended standoff plates 55 are shown suitably fixed to the cap plate 57 and the end bar 58 is shown suitably fixed to each extended standoff plate 55. The handle 61 is shown suitably fixed to the dock plate 59. The handle 61 is used to hold the dock attachment fixture 49 while the dock attachment fixture is being fixed to the dock 47 or while the dock attachment fixture 49 is being removed from the dock 47.

The rotation bar 62 is shown suitably fixed to the first end of the elongated shaft 68. The elongated shaft 68 is shown with threads 69 that suitably mesh with the threads of the wing nut 66. The wing nut 66 is shown above the wing nut washer 67. Part of the first elongated arm 50 and the second elongated arm 51 are shown extending from the dock attachment fixture 49.

Figure 12:
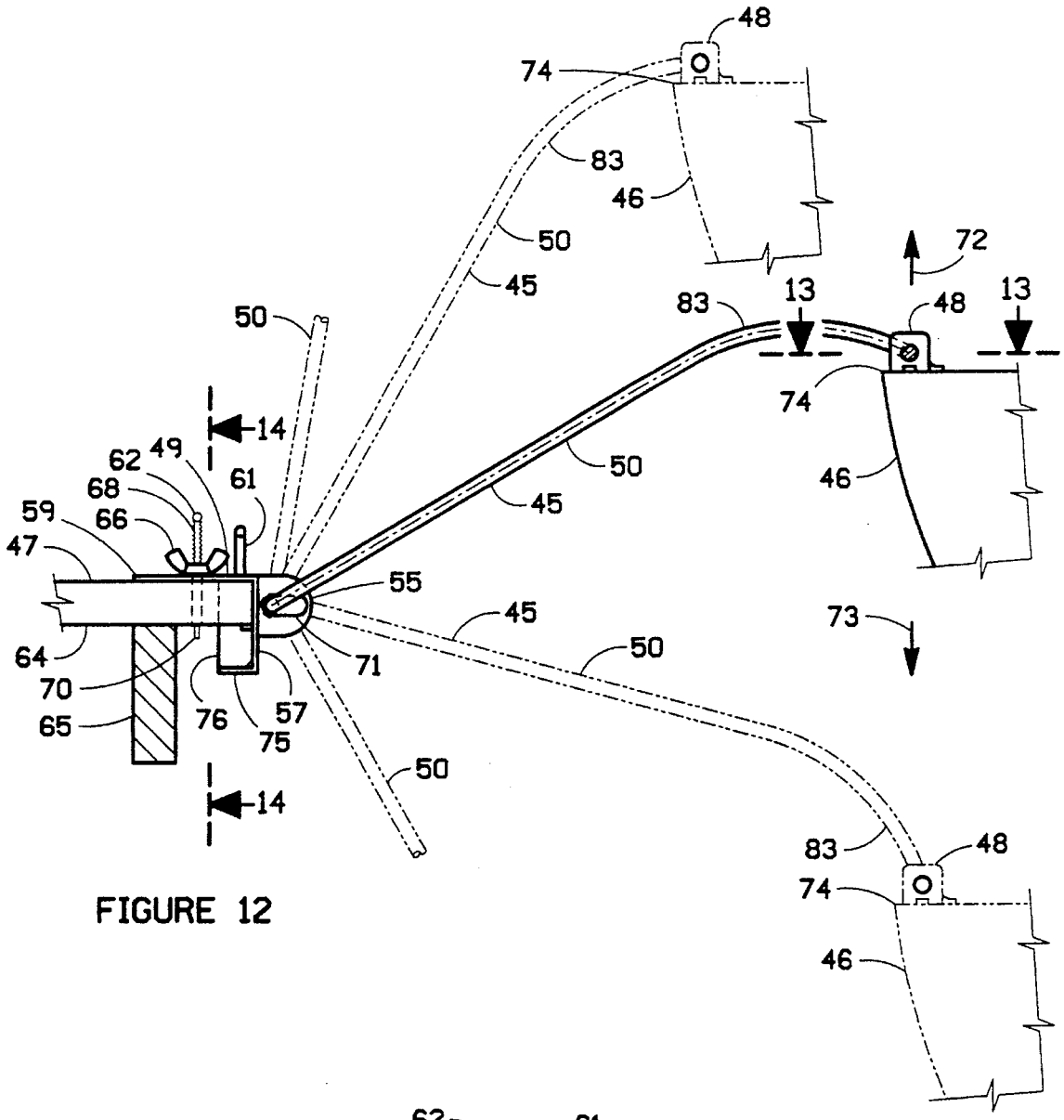
FIG. 12 is another section elevation as taken through FIG. 10.

Referring to FIG. 12, there is shown a side section elevation view of the boat to dock standoff 45 shown suitably fixed to a boat 46 at the first end of the first elongated arm 50 and to a dock 47 near the second end of the first elongated arm 50 as taken through FIG. 10.

The first elongated arm 50 is shown in five positions but it could be in an infinante number of postions as the boat 46 moves up 72 and down 73 in the waves or tides. The first elongated arm 50 is shown curved 83 near the first end to allow the boat to move in an upward position and still prevent the first elongated arm 50 from hitting the outer corner 74 or edge of the boat 46.

The first end of the first elongated arm 50 is shown held in place in the standoff fixture 48 that is suitably attached or fixed to the boat 46. The second end of the first enongated arm 50 is shown suitably held in place in the extended standoff plate 55. The extended standoff plate 55 is shown suitably fixed to the cap plate 57. Below the cap plate 57 is the cap flange 75 that is suitably fixed to the cap plate 57. A slot plate 76 is shown suitably fixed to the cap plate 57 and the cap flange 75. The slot plate 76 is shown in the slot formed between the boards 64 that form the dock 47 to prevent the dock attachment fixture 49 from moveing latterally along the dock 47 while the dock attachment fixture 49 is being attached to the dock 47 or after it has been suitably attached to the dock 47.

The handle 61 is shown suitably attached to the dock plate 59. The handle 61 is placed on the boat to dock standoff 45 to allow the person attaching the dock attachment fixture 49 to the dock 47 to safely hold the dock attachment fixture 49 while it is being guided into the slot and while the elongated shaft 68, T-bar 70 and wing nut 66 are being tightened to the dock 47 or loosened from the dock 47. The rotation bar 62 is shown in the first end of the elongated shaft 68.

Below the dock 47 there is shown the dock beam 65 that supports the boards 64 of the dock 47.

Figure 13:
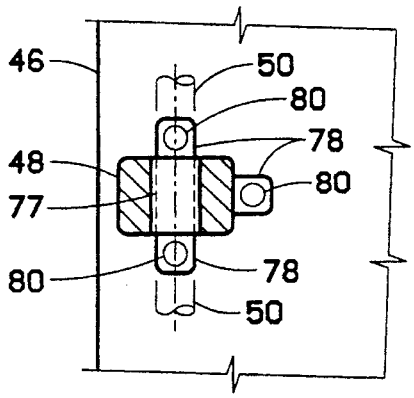
FIG. 13 is a section elevation as taken through FIG. 12.

Referring to FIG. 13 there is shown a section plan view as taken through FIG. 12.

The standoff fixture 48 is shown suitably fixed to the boat by screws or bolts that are inserted into holes 80 formed in the screw or bolt extentions 78 that are suitably fixed to the standoff fixture 48. The screws or bolts prevent the standoff fixture 48 from moving relative to the boat.

The first end of the first elongated arm 50 is shown inside of the elongated arm hole 77 formed in the standoff fixture 48. The elongated arm hole 77 is formed in the standoff fixture 48 and extends from the first side to the second side of the standoff fixture 48 and is a greater diameter than the first end of the elongated arm 50 to allow the elongated arm 50 to rotate sufficiently as the boat 46 moves up and down in the waves relative to the dock. The retainer pin and the dock plate and washer are not shown for clearity.

Figure 14:
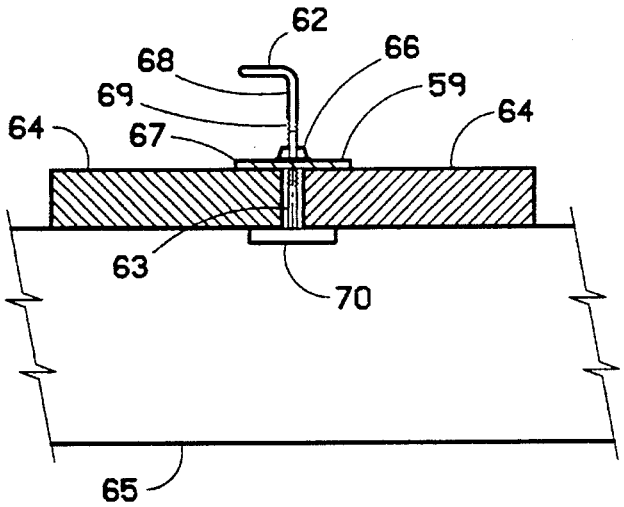
FIG. 14 is a section plan view as taken through FIG. 12.

Referring to FIG. 14 there is shown a section elevation as taken through FIG. 12.

The elongated shaft 68 is shown with a first end and a second end. Threads 69 are shown near the second end of the elongated shaft 68. The T-bar 70 is fixed to the first end of the elongated shaft 68 is shown inserted into the slot 63 formed by the two boards 64 and rotated to where the T-bar 70 spans the slot 63 and is pulled up into the underside of the boards 64. The wing nut 66 with threads formed on the inside hole of the wing nut mesh with the threads 69 of the elongated shaft 68. The wing nut 66 is turned in the suitable direction, thus forcing the second end of the wing nut 66 to press on the first side of the wing nut washer 67 thus forcing the second side of the wing nut washer to press on the first side of the dock plate 59 and further forcing the second side of the dock plate 59 to press on the upper side of the boards 64 and further pulling the elongated shaft 68 and the upper side of the T-bar 70 into the underside of the boards 64.

To determine the direction of the T-bar 70 in referrence to the boards 64 the rotation bar 62 is shown suitably fixed to the first end of the elongated shaft 68 or is part or integrel with the first end of the elongated shaft 68 by bending the first end of the elongated shaft 68. The rotation bar 62 is bent or attached to the first end of the elongated shaft 68 in the same direction relative to the T-bar 70. This will enable a person to rotate the T-bar 70 in the necessary direction without having to look at the T-bar 70 below the boards 64.

Figure 15:
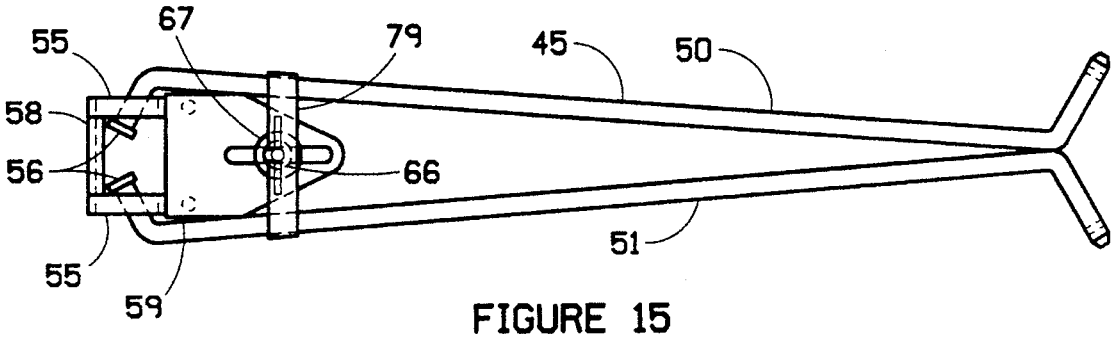
FIG. 15 is a plan view of the second preferred embodiment shown folded up for storage.

Referring to FIG. 15 there is shown a plan view of the boat to dock standoff 45 in a folded or storage position.

The first elongated arm 50 and the second elongated arm 51 are shown pulled together and bound together by a tie clamp 79 that is suitably fasened and held to the boat to dock standoff 45 and the dock plate 59 by the wing nut 66 and or wing nut washer 67. The second end of the first elongated arm 50 and the second elongated arm 51 are held in place in the extended standoff plates 55 by the end caps 56 that cannot be pulled through the elongated slot formed in the extended standoff plates 55. The end bar 58 is shown for reference purposes.

Although the system described in detail supra has been found to be most satisfacory and preferred, many variations are possible. For example the first arm and the second arm on each preferred embodiment could be curved or bowed in a horizontal plane or a vertical plane, the cleat clamping device or cleat hook could be any kind of a snap or a rope or an elastic or rubber tie.

Although the invention has been described with reference to the preferred embodiments it will be understood by those skiled in the art that additions, modifications, substitutions, deletion and other changes not specifically described may be made in the embodiments herein, it should be understood that the details herein are to be interpreted as illustrative and are not in a limiting sence.

What is claimed as invention is:

1. A boat and dock standoff wherein at least one said boat and dock standoff is fixed to a cleat mounted on a boat and further fixed to a wooden dock with boards for preventing said boat from contacting said dock or drifting away from said dock due to waves, tides or winds comprising:

at least one cleat hook wherein said cleat hook is fixed to said cleat;

at least one pivot plate wherein said pivot plate has a first end and a second end and said pivot plate is fixed to said cleat hook;

at least one first arm wherein said first arm has a first end and a second end and wherein said first end of said first arm is flexibly attached to said second end of said pivot plate;

at least one second arm wherein said second arm has a first end and a second end and wherein said first end of said second arm is flexibly attached to said second end of said pivot plate;

at least one first dock attachment device comprised of a vertical pivot plate with a first end and a second end wherein said first end of said vertical pivot plate is flexibly attached to said second end of said first arm and wherein said first dock attachment device is further comprised of a T-bar, an inner rod with a first and a second end wherein said inner rod has threads formed on said inner rod and said second end of said inner rod is fixed to said T-bar, an inner tube around said T-bar, a rotation ring around said inner tube, a lower washer fixed to said inner tube, an upper washer on said inner tube and a wing nut with threads that suitably mesh with said threads on said inner rod and said vertical pivot plate that is fixed to said rotation ring;

at least one second dock device comprised of a vertical pivot plate wherein said vertical pivot plate is fixed to a rotation ring and wherein said rotation ring is held in place around an inner tube, an upper washer and a lower washer and said inner tube is held in place by a wing nut on an inner rod and said inner rod is held to said dock by a T-bar rotated below said boards wherein said second end of said second arm is flexibly fixed to said second vertical pivot plate and said first arm is flexibly fixed to said first dock attachment device and wherein said first arm fixed to said first dock attachment device is fixed to said dock and said second arm is fixed to said second dock attachment device is further fixed to said dock thereby forming a rigid or semi-rigid triangle between said dock and said boat cleat, the first arm and the second arm thereby preventing the boat from moving forward or aftward or from moving directly toward said dock or directly away from said dock thereby allowing said boat to move in a rotational direction up or down without striking said dock.

2. The boat and dock standoff of claim 1 wherein said first arm and said second arm are further comprised of an outer bar and an inner bar wherein said inner bar is partially disposed inside of said outer bar in a telescopic form wherein said first arm and said second arm may be elongated or shortened as required or desired.

3. The boat and dock standoff of claim 1 wherein a rotation bar is fixed to the first end of said inner rod wherein said rotation bar may be grasped with the fingers to turn said inner rod and said T-bar in the desired direction.

4. The first arm and the second arm of claim 2 wherein said inner and outer bar of said first arm and said second arm have holes formed in said inner bar and said outer bar wherein when said holes are aligned and a stop pin is inserted into said holes wherein said first arm and said second arm are made and held at the desired or required length.

5. The boat and dock standoff of claim 1 wherein when said boat is fixed to said dock standoff, said boat will be allowed to move up or down relative to said dock in said waves or tides without striking said dock with said boat.

6. The boat and dock standoff of claim 1 wherein when said boat is fixed to said dock by said boat and dock standoff and said boat will be allowed to have limited movement forward or aftward without striking said dock by said boat.

7. A boat to dock standoff wherein at least one said boat to dock standoff is fixed to a boat or ship and further fixed to a dock or pier made of boards with slots between said boards for preventing said ship or said boat from striking or rubbing said dock or pier or further preventing said boat or ship from drifting away from said dock or pier due to waves, tides or winds reacting on said boat or ship, comprising:

at least one said standoff fixture with a first side and a second side wherein an elongated arm hole is formed in standoff fixture wherein said elongated arm hole extends from said first side to said second side of said standoff fixture and wherein said standoff fixture is mounted on said boat;

at least one elongated arm wherein said elongated arm has a first end and a second end and wherein said first end of said elongated arm is bent and wherein said bent first end of said elongated arm is inserted into said elongated arm hole formed in said standoff fixture mounted on said boat or ship and wherein said second end of said elongated arm is bent and has an end cap fixed to said elongated arm;

at least one dock attachment fixture, comprised of a dock plate, with a first end and a second end and wherein said dock plate has a horizontal elongated slot formed near said second end of said dock plate, a cap plate fixed to said first end of said dock attachment fixture, at least one extended standoff plate with at least one elongated slot formed in said extended standoff plate, an elongated shaft with a first end and a second end wherein said elongated shaft has threads formed near said second end of said elongated shaft, a T-bar fixed at the first end of said elongated shaft, a wing nut with threads that mesh with said threads formed on said elongated shaft wherein said elongated shaft is disposed in said wing nut and said elongated shaft is also disposed in said elongated slot formed near said second end of said dock plate and wherein when said second end of said elongated arm is disposed in said elongated slot formed in said extended standoff plate and said elongated arm is prevented from being withdrawn from said slot formed in said standoff plate by said end cap fixed to said second end of said elongated arm and wherein said T-bar fixed to said first end of said elongated shaft is inserted in said slot formed between said boards of said dock or pier wherein said elongated shaft and said T-bar is rotated wherein said T-bar spans said slot between said boards of said dock and wherein said T-bar is pulled up into the underside of said boards and said wing nut is tightened thus fixing said dock attachment fixture to said dock, further fixing said elongated arm to said dock or pier and further fixing said first end of said elongated arm to said standoff fixture mounted on said boat or ship, thereby allowing said boat or ship to move up or down in waves or tides relative to said dock or pier and still not strike or rub said dock or pier with said boat or ship.

8. The boat to dock standoff of claim 7 wherein said dock attachment fixture may be removed from said dock or pier by loosening said wing nut on said elongated shaft, rotating said elongated shaft and said T-bar until said T-bar is parallel to said slot formed between said boards on said dock or pier and further pulling said T-bar and elongated shaft out of said slot.

9. The boat to dock standoff of claim 7 wherein said elongated arm has a curve formed near said second end of said elongated arm to allow said elongated arm to miss the edge of said boat or said ship as the boat or ship moves upward.

10. The boat to dock standoff of claim 7 wherein a handle is fixed to said dock attachment fixture to allow said dock attachment fixture to be set in a desired location and held in place while said T-bar and said elongated shaft are set in position and tightened to said dock or pier or loosened from said dock or pier.

11. The boat to dock standoff of claim 7 wherein a slot plate is fixed to said dock attachment fixture wherein said slot plate is disposed in said slot formed between said boards forming said dock or pier wherein said slot plate prevents said boat or ship from moving forward or aftward while said dock attachment fixture is being set in place or while it is fastened to said dock or pier.

12. The boat to dock standoff of claim 7 wherein a cap plate is fixed to said dock attachment fixture wherein said cap plate further prevents said boat or ship from pushing said dock attachment fixture into a person while the dock attachment fixture is being fastened to said dock or pier or while the dock attachment fixture is being removed from said dock or pier.

13. The boat to dock standoff of claim 7 wherein a rotation bar is fixed to said second end of said elongated shaft, wherein said rotation bar is parallel or perpendicular to said T-bar and will assist in rotating said elongated shaft and further assists in determining which direction said T-bar is rotated on said dock or pier while removing said T-bar from said dock or pier.

14. The boat to dock standoff of claim 7 wherein said first end of said elongated arm has a hole formed that extends from one side to another side of said elongated arm wherein a pin is inserted into said hole after said elongated arm is inserted into said standoff fixture wherein said elongated arm may not be removed from said standoff fixture or said elongated arm may not fall out of said standoff fixture until said pin is removed from said elongated arm.

15. The boat to dock standoff of clam 7 wherein said first arm may be folded with said second arm and a tie clamp may be placed around said first arm and said second arm to hold said first arm and said second arm together for storage purposes.

16. The boat to dock standoff of claim 7 wherein there is a first standoff fixture, and a second standoff fixture fixed to said boat or ship and a first elongated arm with a first end and a second end and a second elongated arm with a first end and a second end wherein said first end of said first elongated arm is inserted into elongated arm hole formed in said first standoff fixture and said first end of said second elongated arm is inserted into said elongated arm hole formed in said second standoff fixture and wherein said second end of said first elongated arm is inserted into an elongated slot formed in said standoff plate and said second end of said second elongated arm is inserted into said elongated slot formed in said standoff plate wherein said first elongated arm and said second elongated arm form a triangular configuration with said boat or ship.

* * * * *